United States Patent [19]

Kappenhagen

[11] Patent Number: 4,570,781

[45] Date of Patent: Feb. 18, 1986

[54] ESCALATOR

[75] Inventor: George A. Kappenhagen, Stroudsburg, Pa.

[73] Assignee: Westinghouse Electric Corp., Pittsburgh, Pa.

[21] Appl. No.: 607,096

[22] Filed: May 4, 1984

[51] Int. Cl.[4] ..... B66B 23/12

[52] U.S. Cl. ..... 198/333

[58] Field of Search ..... 198/333

[56] References Cited

U.S. PATENT DOCUMENTS

| | | | |
|---|---|---|---|
| 4,236,623 | 12/1980 | Ackert | 198/333 |
| 4,362,232 | 12/1982 | Saito et al. | 198/333 |
| 4,397,383 | 8/1983 | James | 198/333 |
| 4,413,719 | 11/1983 | White | 198/333 |

FOREIGN PATENT DOCUMENTS

| | | | |
|---|---|---|---|
| 0009281 | 1/1977 | Japan | 198/333 |
| 0041378 | 3/1977 | Japan | 198/333 |

*Primary Examiner*—Joseph E. Valenza
*Assistant Examiner*—Lyle Kim
*Attorney, Agent, or Firm*—D. R. Lackey

[57] ABSTRACT

An escalator in which the lateral edge of each step is provided with a resilient, cleated demarcation strip. The outermost cleat of the demarcation strip is flexibly and integrally hinged to the remaining portion of the demarcation strip, and is movable from an unbiased position towards, and away from the adjacent skirt panel, to first and second stops, respectively. The first and second stops assure long life in flexure, and the first stop limits the forces which can be applied to the skirt via the cleat. In another embodiment of the invention, the surfaces of the step-skirt demarcation strips which are exposed to the passengers are provided with a surface configuration which resists sliding movement of an object towards the skirt panel.

8 Claims, 9 Drawing Figures

FIG. 1
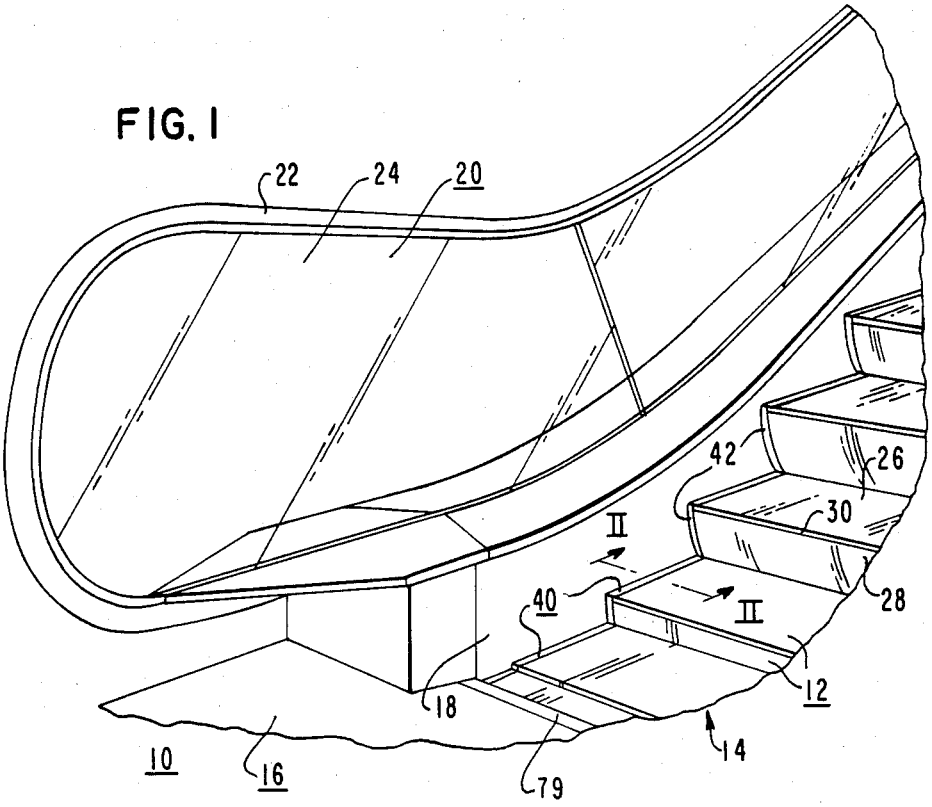
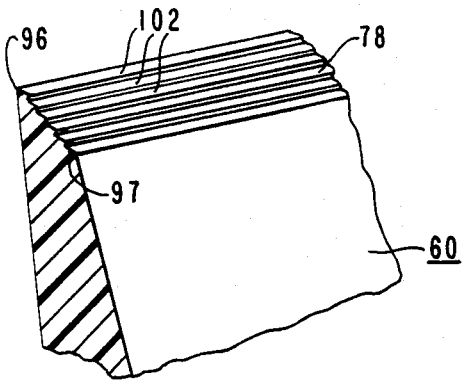
FIG. 7

ESCALATOR

BACKGROUND OF THE INVENTION

1. Field of the Invention

The invention relates in general to escalators, and more specifically, to escalators having a demarcation strip adjacent to the lateral edge of each step.

2. Description of the Prior Art

U.S. Pat. No. 2,981,397 discloses several embodiments of escalators directed to reducing the possibility of objects entering and being caught between relatively moveable parts of an escalator. In one embodiment, the outer tread cleat located at each lateral edge of each step tread part is formed of a resilient material bendable in a direction which tends to close the step-skirt gap, should force be applied to it.

U.S. Pat. No. 3,986,595 discloses a two-element arrangement designed to narrow the step-skirt gap, including a sensor element actuated by a passenger which in turn operates a displacement element located to narrow the gap.

U.S. Pat. No. 4,236,623 discloses placing a plastic strip along each lateral edge of the step tread. The strips include ribs which extend into the grooves between the tread cleats, with the upper portion being dimensioned to narrow the running clearance between the steps and the skirts. The upper portion also includes an inclined ramp to guide objects away from the step-skirt interface.

U.S. Pat. No. 4,397,383 discloses placing a resilient strip along each lateral edge of a step tread, which has a rib for extending into the groove between the two outermost tread cleats. The upper portion is cantilevered towards the skirt and is designed to permit substantial flexure under the weight of a passenger's foot, and to also bend to permit release of an object should it become entrapped between the cantilevered portion of the strip and the skirt.

U.S. Pat. No. 4,413,791 closes the step-skirt gap entirely in one embodiment, by providing continuous sliding contact between the plastic bearing plates fixed to the sides of the steps, and the adjacent skirt. In another embodiment, resilient "curbs" have ribs which snap into the grooves between the tread cleats at the lateral edges of a step. An upper portion extends towards and makes continuous contact with the adjacent skirt.

SUMMARY OF THE INVENTION

Briefly, the present invention is an escalator in which the lateral edge of each step is provided with a resilient, cleated demarcation strip which adds teeth or cleats to the tread part. In addition to providing a visible indication of the step-skirt gap, the demarcation strip includes a protector cleat adjacent to the skirt which is flexibly hinged to the remaining portion of the demarcation strip. The protector cleat extends above the normal step-skirt gap, and it blocks access to the conventional step-skirt gap by easily moving from an unbiased configuration towards the skirt when a small force is applied thereto. Substantially simultaneously with the contacting of the skirt by the protector cleat, a first stop is reached which terminates the easy hinged movement of the cleat, to limit the forces which can be applied to the skirt via the cleat. Should an object get between the protector cleat and the skirt, a withdrawal force easily moves the protector cleat away from the skirt, through and beyond its unbiased configuration. The cleat immediately adjacent to the protector cleat provides a second stop, limiting the hinged movement of the protector cleat between the first and second stops to assure a long useful operating life of the demarcation strip.

Another aspect of the invention, which may be used with the protector cleat embodiment, or with other types of demarcation strips, provides means on the faces or surfaces of the resilient demarcation strip which are exposed to the passengers, configured to increase the sliding resistance of an object which would tend to move towards the skirt, while facilitating such movement away from the skirt.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which:

FIG. 1 is a fragmentary, perspective view of an escalator illustrating demarcation strips for the step-skirt interface which may be constructed according to the teachings of the invention;

FIG. 7 is a fragmentary view of a demarcation strip illustrating another embodiment for the surfaces of the demarcation strip which are exposed to the passenger;

DESCRIPTION OF THE PREFERRED EMBODIMENTS

Figure 2:
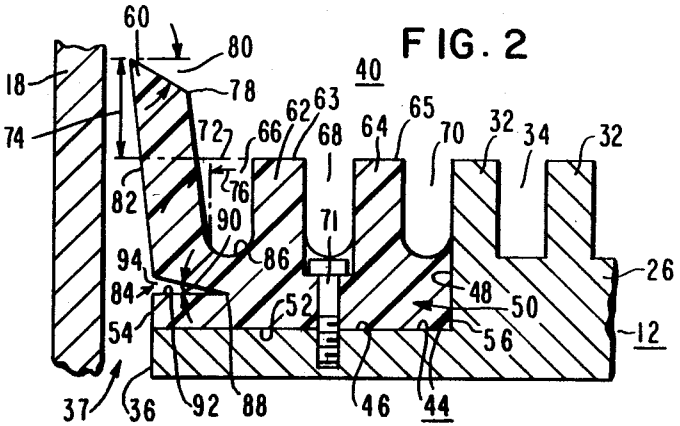
FIG. 2 is a cross-sectional view of a demarcation strip constructed according to a first embodiment of the invention, taken between and in the direction of arrows II—II in FIG. 1.

Referring now to the drawings, and to FIGS. 1 and 2 in particular, there is shown a moving stairway or escalator 10 which may be constructed according to the teachings of the invention. FIG. 1 is a fragmentary, perspective view of the escalator 10 adjacent to the lower landing, and FIG. 2 is a cross-sectional view of escalator 10 taken between and in the direction of arrows II—II. Escalator 10 includes a plurality of steps 12 mounted for articulation between a step mode on the inclined portion of a load-bearing run 14, and platform modes in horizontal portions of the load bearing run adjacent to the upper and lower landings, such as the lower landing 16. Steps 12 are driven about an endless loop by drive means (not shown). The steps may be driven in a conventional manner, such as illustrated in U.S. Pat. No. 3,414,109; or, they may be driven by the modular drive arrangement disclosed in U.S. Pat. No. 3,677,388, both of which are assigned to the same assignee as the present application. These patents are hereby incorporated into the present application by reference.

Stationary skirt panels, such as skirt panel 18, also commonly called skirt boards, are disposed immediately adjacent to the lateral edges or sides of the steps 12. A balustrade 20 extends upwardly from each of the two spaced skirt boards 18, for guiding a continuous flexible handrail 22 on each side of the steps 12. Balustrade 20 may be formed of transparent panels 24, as shown in FIG. 1, or opaque panels, as desired.

Each step 12 includes a horizontally oriented tread part 26, and a riser part 28. The riser part 28 curves downwardly from the front or nose 30 of each tread part 26, and it makes about a 60° angle adjacent to the tread part of the next lower step. As shown more clearly in FIG. 2, each tread part 26, which is usually formed of a metal, such as aluminum, includes a plurality of spaced cleats 32 which define grooves 34 oriented in the direction of step motion. Each lateral edge of each step, such as lateral edge 36 which provides a step-skirt gap 37, is provided with a demarcation strip 40 for highlighting the tread-skirt interface, and for limiting or blocking access to the step-skirt gap 37. A demarcation strip 42 may also be provided for the riser-skirt interface.

A first embodiment of the invention applies primarily to the tread-skirt interface. A second embodiment, which relates to a surface configuration which has unequal sliding resistances in opposite directions, may be applied to both the tread-skirt and riser-skirt interfaces.

As shown in FIG. 2, instead of continuing the cleats 32 and grooves 34 to each lateral edge 36 of the tread part 26, as in a conventional tread part, the tread part 26 is constructed with a recess 44 along each lateral edge. The recess 44 may have any desired configuration. For purposes of example, recess 44 may be defined by a smooth flat surface 46 which starts at edge 36 and extends inwardly for a predetermined dimension. A flat surface 48, perpendicular to surface 46, completes the recess 44.

Demarcation strip 40 includes a base portion 50 configured to snugly fit the recess 44. In the example given for the recess 44, the base 50 and demarcation strip 40 has a substantially rectangular cross-sectional configuration, including a flat bottom surface 52 and first and second side portions 54 and 56. Bottom surface 52 engages support surface 46 of recess 44, and the second side surface 56 engages the perpendicular surface 48 of recess 44. The first side surface 54 of base 50 is substantially flush with the lateral edge 36 of tread part 26, and it faces the adjacent skirt 18.

A plurality of spaced cleats rise vertically upward from base 50 and demarcation strip 40, with the spaced cleats continuing to add cleats to the metallic cleats 32 of the tread part 26, until reaching the lateral edge 36 of the step. Demarcation strip 40 will usually include at least two cleats, with three cleats being shown for purposes of example in FIG. 2. The three cleats are referenced 60, 62 and 64 with cleat 60 being the protector cleat which is immediately adjacent to the adjacent skirt panel 18. Groove 66 separates cleats 60 and 62, groove 68 separates cleats 62 and 64, and groove 70 separates cleats 64 from the outermost cleat 32 of tread part 26. Grooves 66, 68 and 70 are parallel with the grooves 34 in the tread part 26, and are oriented in the direction of step motion. Suitable fastener means, such as screws, indicated as 71, may be used to firmly secure demarcation strip 40 in the recess 44.

An important criterion for the material of which demarcation strip 40 is formed is the ability to maintain its strength after repeating flexing. Thus, demarcation strip 40 is preferably formed of a resilient plastic material, with a suitable plastic material being polypropylene.

The first or outer cleat 60 has several important characteristics. Its most important characteristic is the ability to easily flex within a predetermined range under the influence of relatively small forces, while either resisting movement outside of this predetermined range or requiring substantially higher forces to effect any further movement. The outer cleat 60 preferably has an unflexed or unbiased configuration between the limits of the predetermined flexural range, such that cleat 60 is not normally in contact with skirt 18, but is closely adjacent thereto. Another important characteristic for cleat 60 is the requirement that, upon flexing, it should reach one of the limits of the predetermined flexure range substantially simultaneously with the cleat 60 contacting the skirt 18, to thus block access to the conventional skirt-step gap 37 when a force is applied to cleat 60, while resisting further movement which would transfer high frictional forces into the skirt 18 via the cleat 60. Another important characteristic of cleat 60 is its height, with it being more effective if it extends above the level 72 of the cleats 32, as indicated by added dimension 74. Cleats 64 and 62 may be the same height as cleats 32, or they may increase step-wise from cleat 32 to cleat 64, from cleat 64 to cleat 62, and from cleat 62 to cleat 60, as desired. Cleat 60, instead of being perpendicular, may be inclined slightly from the vertical toward skirt 18, as indicated by angle 76, in order to provide a narrow running clearance, without actually contacting the skirt in its unbiased configuration.

The second limit of the predetermined range of flexure should permit easy withdrawal of an object which happens to get between cleat 60 and skirt 18, while limiting the flexure range to assure a long and useful life for the demarcation strip. In a preferred embodiment, the second limit is provided by the second cleat 62.

Another desirable characteristic of cleat 60 is that it should deflect an object back towards the central portion of the associated step, and thus its upper surface 78 is preferably angled downwardly from the horizontal by a predetermined angle, as indicated by angle 80 in FIG. 2.

The cleated upper surface of demarcation strip 40 simplifies any modifications which must be made to the comb plate 79 shown in FIG. 1. The modifications required are simply those which enable the comb plate 79 to accommodate the increased height of the outer cleat 60. The leading edge of the outer cleat 60 may be tapered to allow the comb fingers of the comb plate 29 to "cam" the outer cleat 60 into the desired alignment.

The characteristic of demarcation strip 40 which enables cleat 60 to easily flex until it just makes contact with skirt 18 may be achieved by a construction which effectively hinges cleat 60 to the remaining portion of the demarcation strip 40 via the material of which the demarcation strip is formed. For example, the lateral surface 82 which forms the first side 54 of the demarcation strip 40 may include an opening or recess 84 which extends along the complete length of the demarcation strip 40. The opening 84 extends into the base 50 for a predetermined dimension, dividing this portion of the base into upper and lower portions, with the predetermined dimension extending past the cleat 60 until it is substantially at the midpoint of groove 66. The effective "pivot axis" of the hinged movement of cleat 60 is thus located in the plastic material between the bottom 86 of groove 66 and the inner edge 88 of opening 84. Selection of the distance between the groove bottom 86 and the innermost end 88 of opening 84 is an important factor in determining the amount of force required to flex cleat 60 from an unbiased configuration to its first and second stops.

Figure 3:
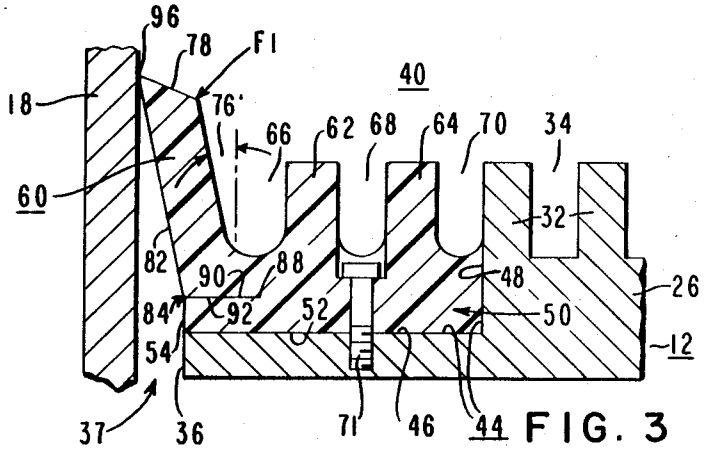
FIG. 3 is a view of the demarcation strip shown in FIG. 2, under the influence of a force which has flexed the outermost cleat to its first limit.

The dimensions and configuration of recess are selected to provide a first stop which provides one limit for the flexural range of cleat 60. As shown in FIG. 2, recess 84 may have a V or wedge-shaped configuration in cross section, with the recess being defined by two flat surfaces 90 and 92 which intersect at 88 and define an angle 94. As illustrated in FIG. 3, angle 90 is selected such that when a force F1 is applied to cleat 60 which causes it to flex towards skirt 18 and increase angle 76 to angle 76', surfaces 90 and 92 contact one another and establish the first limit at substantially the same instant that lateral edge 96 of cleat 60 contacts skirt 18. Access to the conventional skirt-gap 37 is blocked the instant cleat 60 contacts skirt 18, and no further purpose is served by allowing the force F1 to be transferred into skirt 18. In fact, such transfer of forces should be avoided, as it would wear and mar the skirt and cleat, and it would add an unnecessary frictional load to the escalator drive. Cleat 60 is substantially stiffened when surfaces 90 and 92 contact one another, as further movement is resisted by the full dimension of the plastic material from bottom 86 of groove 66 to surface 52 of base 50, and by the metallic support provided by surface 46 of the tread part 26.

A second stop for providing the remaining limit to the flexural range of the protector cleat 60 is conveniently provided by the second tooth 62. It is important to have a significant range of movement of cleat 60 from its unbaised configuration shown in FIG. 2, to the second limit provided by cleat 62. In other words, the unbiased configuration of cleat 60 should place it close to the first limit, allowing substantial movement of cleat 60 from the unbiased configuration before it reaches the second limit. If something should start to wedge between cleat 60 and step 18, pulling back on the object being entrapped creates a force F2 which will easily move cleat 60 about its "hinge-point" or flexural pivot axis, suddenly increasing angle 94 to angle 94', which greatly increases the distance between edge 96 of cleat 60 and skirt 18. Cleat 60 contacts cleat 62 at line contact 96 to limit the amount of flexure, and thus assure long flexural life for the demarcation strip 40.

Figure 4:
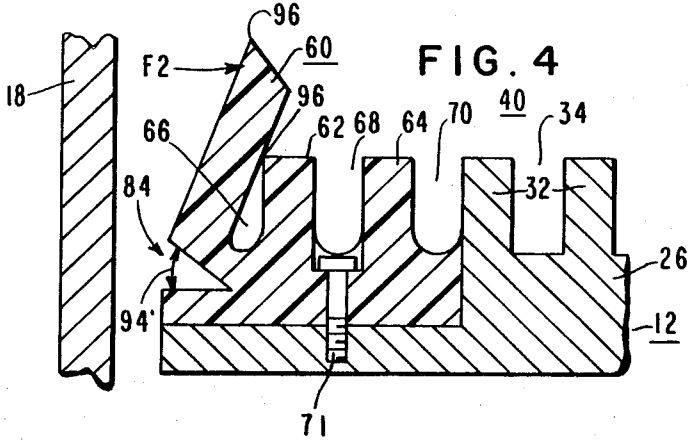
FIG. 4 is a view of the demarcation strip shown in FIG. 2, under the influence of a force which has flexed the outermost cleat to its second limit.
Figure 5:
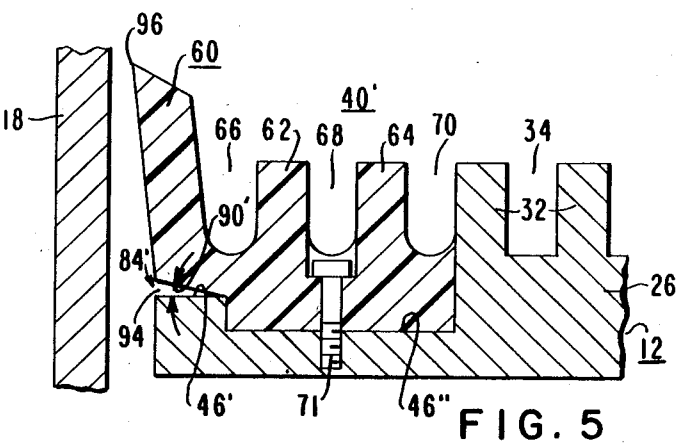
FIG. 5 is a cross-sectional view of a demarcation strip constructed according to another embodiment of the invention.

While the embodiment of FIGS. 2, 3 and 4 is a preferred embodiment, the desired functions of demarcation strip 40 may be achieved by other configurations. An example of a suitable alternative embodiment is set forth in FIG. 5. Like reference numerals in FIGS. 2 and 5 indicate unmodified components, and components which are similar but slightly modified are given the same reference numeral along with a prime mark in FIG. 5. The embodiment of FIG. 5 illustrates that angle 94 may be provided by an opening 84' formed between surface 90' of a demarcation strip 40' and a metallic surface 46' of the tread part 26. Thus, no opening need be formed in the side of demarcation strip 40'. Surface 46' of the FIG. 5 embodiment includes two horizontally offset flat portions 46' and 46'', forming a U-shaped recess which, in addition to removing the requirement of having an opening in the side of the demarcation strip, will also more positively locate and maintain the position of the demarcation strip 40' relative to the tread part 26.

Figure 6:
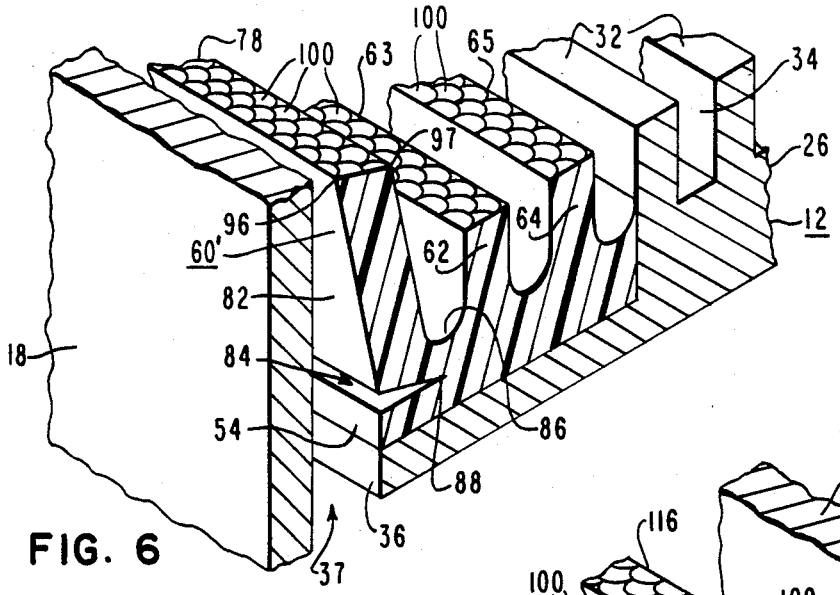
FIG. 6 is a perspective view of the demarcation strip shown in FIGS. 2, 3 and 4, in which the surfaces exposed to the passengers are formed to present a higher resistance to movement of an object towards the adjacent skirt panel, than in the opposite direction.

FIG. 6 is a perspective view of the FIG. 2 embodiment of the invention, illustrating the surfaces of demarcation strip 40 which are exposed to the passengers on the escalator 10. According to another aspect of the invention, these surfaces, which include surface 78 of cleat 60, and the upper surface 63 and 65 of cleats 62 and 64, respectively, are provided with a configuration which increases their resistance to the sliding movement of an object over them in a direction towards the immediately adjacent skirt 18, i.e., from lateral edge 97 to lateral edge 96 of cleat 60, for example. Sliding resistance of the same object over these surfaces in a direction away from the adjacent skirt 18, from lateral edge 96 to lateral edge 97 of cleat 60, for example, is much less than in the first-name direction. This result may be achieved by a "fish-scale" surface, which includes a plurality of overlapped "scales" 100. The scales 100 are oriented and overlapped such that the exposed vertical edges of the scales are contacted by an object sliding towards the skirt 18, requiring the body to overcome each perpendicular surface of each scale 100. Movement of an object away from skirt 18, on the other hand, is not blocked by the perpendicular edges of the scales 100, thus providing much less sliding resistance. Scales 100 may be conveniently molded into the surfaces 78, at the time demarcation strip 40 is formed.

Figure 8:
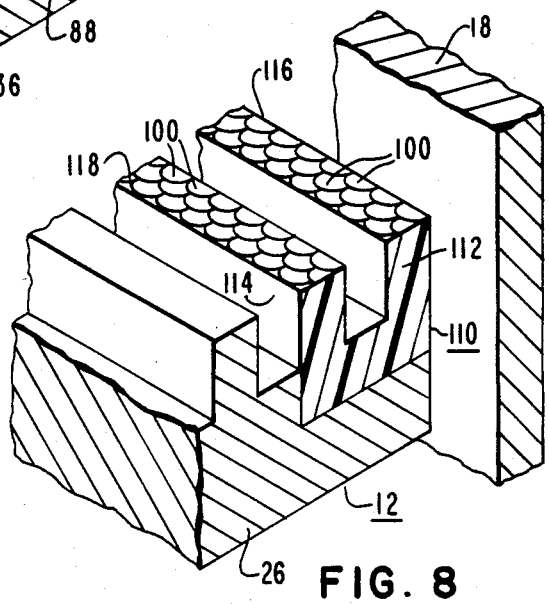
FIG. 8 is a fragmentary, perspective view of a demarcation strip illustrating an embodiment of the invention wherein the exposed surfaces which have the altered sliding resistance may be the upper surfaces of tread cleats.
Figure 9:
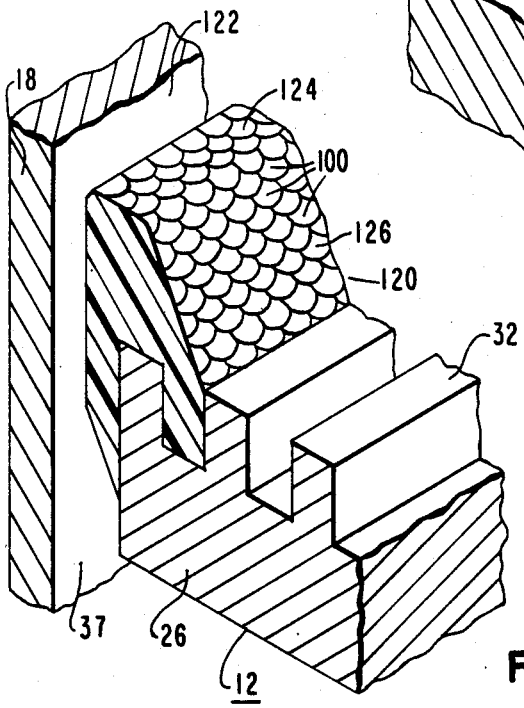
FIG. 9 is a fragmentary, perspective view of a demarcation strip illustrating an embodiment of the invention wherein the exposed surfaces of a demarcation strip which have an altered sliding resistance may be a strip of the type which narrows the running clearance between the steps and skirt.

FIG. 7 is a fragmentary view, in perspective, of cleat 60, illustrating that the desired function of scales 100 may be achieved by a surface having a plurality of steps 102, similar to overlapped siding. The FIG. 6 embodiment would lend itself to a molding process for forming demarcation strip 40, while the FIG. 7 embodiment would lend itself to either molding or extruding. Movement of an object toward skirt 18 would cross the steps in an "ascending" direction, while movement in the opposite direction would be the "descending" direction, offering much less resistance than an object which would attempt to slide in the ascending direction. FIGS. 8 and 9 illustrate that the aspect of the invention which modifies the step surfaces adjacent to the skirt which are exposed to passengers, first set forth via the FIG. 6 embodiment of the invention, need not be confined to a demarcation strip which blocks access to the conventional skirt-step gap. The FIG. 8 embodiment illustrates a plastic demarcation strip 110 whose primary function is to highlight the step-skirt interface. Demarcation strip 110 has any desired number of cleats adjacent to the lateral edge of the step, such as cleats 112 and 114. Cleats 112 and 114 have surfaces 116 and 118, respectively, which are exposed to the passengers. A configuration of scales 100, as shown in FIG. 8, or the stepped configuration 102 shown in FIG. 7, or any other configuration which increases the sliding resistance towards the skirt, is defined by the surfaces 116 and 118.

The FIG. 9 embodiment illustrates a plastic demarcation strip 120 which, in addition to the function of highlighting the step-skirt interface, also partially closes the step-skirt gap 37 to provide a running clearance 122 which is narrower than the skirt-step gap 37. Demarcation strip 120 includes a horizontally oriented surface 124 and an inclined surface 126, which surfaces are exposed to passengers on the escalator. Both of these exposed surfaces may have a surface of scales 100, as illustrated, they may have the stepped surface 102 of FIG. 7, or any other configuration which increases the sliding resistance over these exposed surfaces towards the skirt 18, while facilitating such movement away from the skirt.

In summary, there has been disclosed a new and improved escalator having a step-skirt demarcation strip at each lateral edge of each escalator step which provides an auxiliary step-skirt interface located well above the conventional step-skirt interface. This auxiliary step-skirt interface normally has a small running clearance, which closes completely when a slight force is applied to the demarcation strip directed in a direction towards the skirt. While the demarcation strip moves easily and quickly to close the running clearance under the influence of a relatively small force, substantially simultaneously with contact between the demarcation strip and skirt, the easy movement mode abruptly ceases, to limit the magnitude of the forces which can be transmitted to the skirt through the demarcation strip. Should an article start to enter the small gap between the auxiliary step-skirt interface, it may be easily pulled back before the article reaches the conventional step-skirt interface. A demarcation strip, when subjected to a force directed away from the skirt, has a relatively large easy movement range from the unbiased configuration which quickly opens the gap between the demarcation strip and skirt. Once the object is free, the demarcation strip quickly and automatically returns to its unbiased configuration, which again establishes the correct auxiliary step-skirt interface. Thus, the demarcation strip of the invention highlights the step-skirt interface, as the demarcation strip may be formed of a color which contrasts with the normal step color, it blocks access to the conventional step-skirt gap by providing an auxiliary step-skirt gap raised well above the conventional gap, it is movable to completely close the auxiliary step-skirt running clearance when subjected to a relatively low force, without transferring undue forces into the skirt, and the auxiliary step-skirt gap is easily opened for easy withdrawal of an object which may get into the auxiliary step-skirt gap.

In another aspect of the invention, the surfaces of the demarcation strip which are exposed to the passengers on the escalator are formed such that their resistance to an object being moved over the surface towards the skirt is increased, compared with such resistance in the opposite direction. This aspect of the invention may be applied to the demarcation strip of the invention, or it may be applied to other types of demarcation strips, with examples of such other types being set forth in the FIG. 8 and FIG. 9 embodiments. The surface modification set forth in the embodiments of FIGS. 6 through 9 may also be applied to demarcation strip 42 which highlights the step riser-skirt interface.

I claim as my invention:

1. An escalator including a plurality of steps having lateral edges which move in spaced relation past stationary skirt panels to define step-skirt gaps, with each step including a tread part having a plurality of spaced, upstanding cleats which start a predetermined dimension from each lateral edge of the step, and with the spaced cleats defining grooves oriented in the direction of step motion, the improvement comprising:

a one-piece, resilient demarcation strip fixed to each step within the predetermined dimension adjacent to each lateral edge, said demarcation strip including at least first and second cleats which extend integrally upward in spaced relation from a common base to define a groove and add additional cleats to the tread part, with the first cleat to the demarcation strip being an outermost cleat which is normally spaced from the adjacent skirt panel, said demarcation strip having a substantially upstanding first surface which faces the adjacent skirt panel and forms one side of said first cleat, and a second surface which extends inwardly from said upstanding first surface for a predetermined dimension, with said second surface extending below the first cleat for the entire length of the first cleat, and stop means, carried by each step, said second surface being spaced from said stop means when said first cleat is unbiased by external forces, said demarcation strip being formed of a material which permits said first cleat to move as a whole, both towards and away from the adjacent skirt panel, under the influence of predetermined minimum external forces which bend a portion of the demarcation strip located between said second surface and the groove disposed between said first and second cleats, said stop means limiting the movement of the first cleat towards the adjacent skirt panel by contact between said second surface and said stop means which occurs substantially simultaneously with contact between the first cleat and the adjacent skirt panel, to limit the magnitude of the forces transferrable from the first cleat into the adjacent skirt panel.

2. The escalator of claim 1 wherein the first and second cleats of the demarcation strip are dimensioned to cause the second cleat to function as a stop which limits the hinged movement of the first cleat away from the adjacent skirt panel.

3. The escalator of claim 1 wherein the base defines a lateral recess along the length of the demarcation strip having a substantially V-shaped cross-sectional configuration, which recess extends inwardly from the upstanding first surface, said lateral recess being defined on one side of the V-shaped configuration by the second surface and on the other side of the V-shaped configuration by a third surface, said second and third surfaces normally being spaced apart in the unbiased configuration of the first cleat, with the stop means including said third surface.

4. The escalator of claim 1 wherein the step includes a support surface which is spaced from the second surface of the demarcation strip below the first cleat when the first cleat is in its unbiased configuration, with the stop means including said support surface of the step.

5. The escalator of claim 1 wherein the first cleat includes an upper surface which slopes downwardly, from the intersection of said upper surface with the upstanding first surface, towards the second cleat.

6. The escalator of claim 1 wherein the first cleat includes an upper surface, said upper surface including means which presents a higher resistance to sliding movement of an object across said upper surface in a direction towards the adjacent skirt panel than in the opposite direction.

7. The escalator of claim 6 wherein the means on the upper surface is a non-smooth surface configuration defining a pattern having a plurality of raised edges which are encountered by sliding movement in a direction towards the adjacent skirt panel, but not in the opposite direction.

8. The escalator of claim 6 wherein the upper surface slopes downwardly in a direction from the adjacent skirt panel towards the second cleat.

* * * * *